United States Patent [19]

Mele

[11] 3,961,636

[45] June 8, 1976

[54] NAIL CARE APPARATUS

[76] Inventor: Arthur N. Mele, 3387 N. Knoll Drive, Los Angeles, Calif. 90068

[22] Filed: Feb. 18, 1975

[21] Appl. No.: 550,771

[52] U.S. Cl. ..... 132/73
[51] Int. Cl.[2] ..... A45D 29/00
[58] Field of Search ..... 132/73, 73.5, 75

[56] References Cited

UNITED STATES PATENTS

| | | | |
|---|---|---|---|
| 968,965 | 8/1910 | MacDonald | 132/73 |
| 2,579,450 | 12/1951 | Libson | 132/73.5 |
| 2,656,842 | 10/1953 | Ammarell | 132/73 |
| 2,760,500 | 8/1956 | Johnson, Jr. | 132/73.5 |

*Primary Examiner*—G.E. McNeill
*Attorney, Agent, or Firm*—Ellsworth R. Roston

[57] ABSTRACT

A finger rest adapted to support a finger of a user to facilitate care of the associated fingernail includes a plurality of shoulder portions defining a channel for receiving the finger and a plurality of sidewalls defining a cavity beneath the channel and interiorly of the finger rest. The cavity is shaped to receive at least one finger care instrument in a press-fit relationship to store the instrument in the finger rest when the instrument is not being used to care for the fingernail.

13 Claims, 6 Drawing Figures

NAIL CARE APPARATUS

BACKGROUND OF THE INVENTION

1. Field of the Invention

This invention pertains generally to finger care devices and more specifically to devices for supporting a finger in an elevated position for care of an associated fingernail.

2. Description of the Prior Art

It is often desirable to care for the fingernails by clipping the nail, cutting the cuticle, filing the nail, or applying various base coats or polishes to the nail. Some people attempt to perform these functions by merely resting the elbow of the associated arm on a stationary surface such as a table while performing a particular function on the nails. This has been undesirable because the stationary surface has been far removed from the fingernail. As a consequence, it has been difficult to hold the fingernail steady during the various nail care functions.

When filing a particular fingernail, a file is moved back and forth across the nail. The friction between the file and the nail, which is desirable for filing, also tends to move the nail being filed. This movement of the nail not only inhibits the filing of the nail but also makes it difficult to view the nail in order to ascertain the degree of filing.

In accordance with the above described method of the prior art, the fingernails have been rather closely positioned to each other. As a consequence, it has been difficult to polish a particular nail without smudging the polish on other nails.

SUMMARY OF THE INVENTION

In accordance with the present invention, a finger rest is defined by a housing having shoulder portions which define a channel. The channel is adapted to receive a particular finger, the fingernail of which is to be cared for. The channel is defined in an elevated position so that the remaining fingers on the hand are separated from the particular finger. In a preferred embodiment, the channel increases in elevation with progressive positions from the back of the finger rest to the front of the finger rest.

The finger rest may define a cavity interiorly of the finger rest which is shaped to receive an instrument such as a bottle or container of fingernail polish. The sidewalls may define a bottom opening into the cavity to facilitate disposition of the instrument in a press-fit relationship in the cavity.

A pair of lateral openings may also be provided on opposite sides of the cavity. These lateral openings permit the sides of the instrument, such as a container of bottle, to be engaged so that the bottle can be easily removed from the cavity. It may be particularly desirable that one of these lateral openings is provided at the front of the finger rest so that the contents of the bottle, such as the fingernail polish, may be viewed through the opening and the bottle. This opening may be provided with the shape of a pointed fingernail to further enhance the appearance of the combination.

These and other features and advantages of the present invention will become more apparent with a description of the preferred embodiments and reference to the associated drawings.

DESCRIPTION OF PREFERRED EMBODIMENTS

Figure 1:
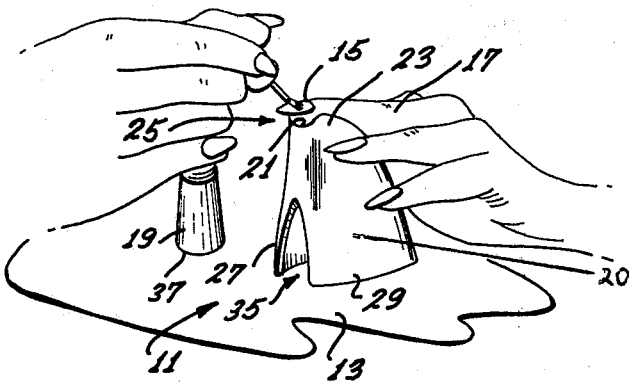
FIG. 1 is a perspective view of one embodiment of a finger rest of the present invention supporting a particular finger while polish is being applied from a bottle to the nail of the supported finger.
Figure 3:
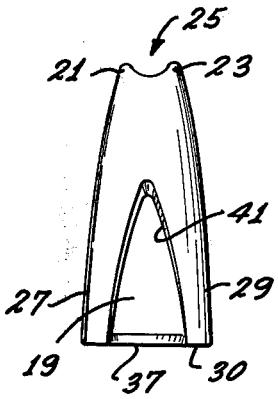
FIG. 3 is a front elevational view of the finger rest illustrated in FIG. 1.
Figure 2:
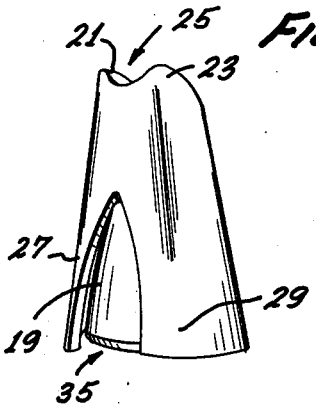
FIG. 2 is a perspective view of the finger rest illustrated in FIG. 1 with the bottle of fingernail polish disposed in a cavity interiorly of the finger rest.
Figure 4:
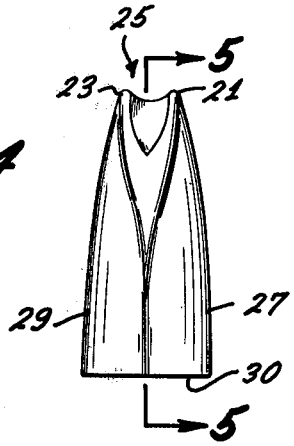
FIG. 4 is a back elevational view of the finger rest illustrated in FIG. 1.

A finger rest is illustrated in FIG. 1 and designated generally by the reference numeral 11. The finger rest 11 is adapted to be positioned on a supporting surface 13 for use in caring for a nail 15 of a particular finger 17. For example, the finger rest 11 may be particularly advantageous for use in supporting the particular finger 17 while the nail 15 is being cut, filed or polished.

The finger rest 11 is further advantageous since it provides a supporting surface in close proximity to the object, such as a nail 15, being cared for. This may be most appreciated when the nail 15 is being filed, since the rest 11 will inhibit movement of the finger 17 relative to a file and thereby facilitate the filing of the nail.

In FIG. 1, a coat of polish is being applied to the nail 15 from a container or bottle 19. It is of particular advantage that when operatively disposed, the particular finger 17 is lifted and separated by the finger rest 11 from the remaining fingers on the associated hand. This is particularly desirable for example when the remaining fingers have been polished since it inhibits contact between the adjacent fingers which might otherwise smear the polish.

The finger rest may be formed from material such as glass, plastic, metal, wood, or any combination of these materials.

As best illustrated in FIGS. 2–5, the finger rest 11 includes a housing 20 having shoulder portions 21 and 23 which define a channel 25 adapted to receive the particular finger 17. The shoulder portions 21 and 23 are preferably positioned in an upper area of the finger rest 11 so that the finger 17 is supported in an elevated position above the supporting surface 13. In a particular embodiment, the shoulder portions 21 and 23 may be supported by sidewalls 27 and 29 which extend upwardly from a bottom planar surface 30 to define with the shoulder portions 21 and 23 a continuous surface. In this particular embodiment, the channel 25 is provided at the uppermost regions of the finger rest 11.

It is generally desirable that the shoulders 21 and 23 be separated a distance not greater than a normal distance separating alternate fingers on the associated hand. This will permit the fingers adjacent to the particular finger 17 to fall to a level lower than the channel 25 to provide for the separation of the fingers.

Figure 5:
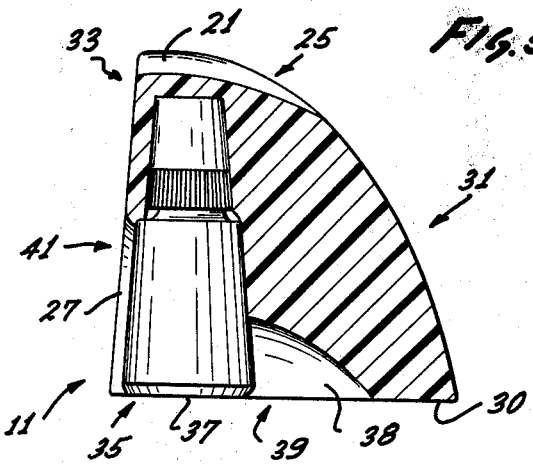
FIG. 5 is a cross-sectional view of the finger rest taken on lines 5—5 of FIG. 4.
Figure 6:
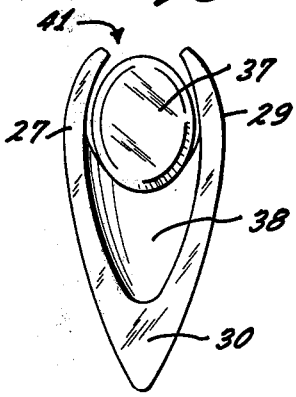
FIG. 6 is a bottom plan view of the finger rest illustrated in FIG. 1 showing the bottle of fingernail polish disposed in a cavity interiorly of the finger rest.

The housing 20 has a back shown generally at 31 in FIG. 5 and a front shown generally at 33 in FIG. 5. The channel 25 increases in elevation with progressive positions from the back 31 to the front 33. When the finger 17 is disposed in the channel 25, the resulting slope facilitates disposition of the finger 17 in the channel 25 with the associated arm of the user resting on the supporting surface 12.

In a preferred embodiment of the finger rest 11, the sidewalls 27 and 29 define a cavity 35 interiorly of the finger rest 11 and beneath the channel 25. This cavity 35 is merely representative of many cavities that can be provided interiorly of the finger rest 11 to provide for storage of various finger care instruments, such as the bottle 19 of fingernail polish. For example, cavities can be provided for buffers, clippers, emery boards, fingernail files, as well as other bottles such as those containing base coat material. In any case, it is generally desirable that the cavity or cavities be shaped to provide a contiguous frictional relationship with the associated instrument. For example, the cavity 35 illustrated best in FIG. 5, is provided with the shape of the bottle 19. Thus the bottle 19 can be press-fit into the cavity 35 to retain the bottle 19 and the finger rest 11 in a substantially fixed relationship when the bottle 19 is not being used.

It may be further desirable that the particular instrument, such as the bottle 19, be positioned in the cavity 35 so that at least a portion of the instrument, such as the bottle 19, rest on the supporting surface 13. For example, in the illustrated embodiment, the bottle 19 has a bottom surface 37 which is disposed in substantially the same plane as the bottom planar surface 30 of the finger rest 11. Thus when the planar surface 30 is disposed in contiguous relationship with the supporting surface 13, the bottom surface 37 of the bottle 19 also contacts the supporting surface 13.

In a particular embodiment of the invention, portions 38 of the finger rest 11, which may include the sidewalls 27 and 29, define a secondary cavity 39 which extends into the cavity 35. Thus when the instrument, such as the bottle 19, is disposed in the cavity 35, a portion of the lateral surface of the bottle 19 can be contacted through the cavity 39.

On the side of the cavity 35 opposite the secondary cavity 39, the sidewalls 27 and 29 may define a lateral opening 41 also extending into the cavity 35. Thus with the bottle 19 disposed in the cavity 35, opposite sides of the bottle 19 can be contacted through the cavity 39 and the opening 41. Thus the portions defining the cavity 39 and the opening 41 provide means for gripping the bottle 19 on opposite sides of the bottle 19 to facilitate removal of the bottle 19 from the cavity 35. It will be apparent that this means might include two of the cavities 39 disposed on opposite sides of the bottle 19. It might also include two of the openings 41 each defined by one of the sidewalls 27 and 29. In the illustrated embodiment, the cavity 39 is disposed at the back of the finger rest 11, while the opening 41 is defined at the front 33 of the finger rest 11. In a particular embodiment, the opening 41 is provided with the shape of a pointed fingernail so that the polish in the bottle 19 can be viewed through the opening 41.

Thus, the finger rest 11 is of particular advantage for providing a stable base for supporting a particular finger in an elevated and separate relationship with the remaining fingers on the hand. The finger rest 11 can be configured to provide for the storage of finger care instruments such as bottles of base coat or polish, clippers, files, and emery boards. By providing cavities with substantially the shape as the instrument to be stored, the finger rest 11 and the instrument can be provided with a press-fit relationship so that the instrument can be carried by merely carrying the finger rest 11. Secondary cavities or openings can be provided for gripping the instrument in the associated cavity to facilitate removal of the instrument from the cavity.

Although the invention has been described with reference to a particular embodiment, it will be apparent that it can be otherwise embodied so that the scope of the invention should be ascertained only with reference to the following claims.

I claim:

1. In combination for use with a container of nail polish, a housing, a pair of sholder portions disposed on the housing and defining a channel for receiving the particular finger, the channel being configured to support the particular finger in a position separated from the remaining fingers on the hand of the user;

the housing including a plurality of sidewalls extending from the shoulder portions to support the shoulder portions in an elevated position and defining at least one cavity substantially directly beneath the channel and interiorly of the housing;

the cavity being shoulder to receive the container of nail polish in a press-fit relationship to store the container when the container is not being used to provide for the polishing of the nail of the particular finger.

2. The combination set forth in claim 1 wherein the container has a bottom surface and the side walls of the housing define a particular surface at their bottom end, the particular surface of the housing being in substantially the same plane as the bottom surface of the container when the container is disposed in the cavity.

3. The combination set forth in claim 1 wherein the shoulder portions defining the channel and the sidewalls defining the cavity are integral.

4. The combination recited in claim 2 wherein the sidewalls define an opening at the particular surface of the housing and wherein the cavity extends upwardly from the opening.

5. The combination set forth in claim 4 wherein at least one of the sidewalls defines a lateral opening extending into the cavity at a position below the channel and providing for the gripping of the container press-fit into the cavity to facilitate the manual removal of the container from the cavity.

6. The combination recited in claim 5 wherein the lateral opening has the shape of a pointed fingernail and extends to the particular surface.

7. The combination set forth in claim 1 wherein the channel extends from the front to the back of the housing and increases in elevation with progressive positions between the back and the front of the housing.

8. In combination for use with a container of fingernail polish to facilitate the polishing of a nail of a finger:

a housing having side walls and a top wall and a bottom surface with a hollow interior to define a cavity extending upwardly from the bottom surface to a position near the top wall of the housing;

the top wall of the housing being indented to define a channel shaped to receive and support a finger in a elevated position at least during the polishing of the nail of the finger with the fingernail polish in the container.

9. The combination recited in claim 8 wherein the bottom surface of the housing has a planar configuration for disposition in contiguous relationship with a supporting surface and the cavity and the container have configurations for disposition of the container in the cavity with the bottom surface of the container in substantially the plane of the bottom surface of the container.

10. The combination set forth in claim 9 wherein the side walls and the top wall of the housing are integral and the top wall of the container extends from the side walls and at least one of the side walls has an opening communicating with the cavity to facilitate a gripping of the container in the cavity for manual removal of the container from the cavity.

11. The combination set forth in claim 8 wherein the channel is disposed above the container when the container is disposed in the cavity.

12. The combination set forth in claim 8 wherein the housing has a back and a front and the channel has a configuration increasing in elevation with progressive positions of the channel between the back and the front of the housing to facilitate the disposition of a finger in the channel.

13. The combination recited in claim 8 wherein the housing has a plurality of sidewalls separated from one another to define the cavity and wherein portions of the sidewalls on opposite sides of the cavity define openings communicating with the cavity to facilitate manual gripping of the container for removal of the container from the cavity.

* * * * *